US007290690B2

(12) United States Patent
Hancock

(10) Patent No.: US 7,290,690 B2
(45) Date of Patent: Nov. 6, 2007

(54) MOUNTING BRACKET

(75) Inventor: Dennis H. Hancock, Mountain Green, UT (US)

(73) Assignee: Stearns, Inc., Sauk Rapids, MN (US)

( * ) Notice: Subject to any disclaimer, the term of this patent is extended or adjusted under 35 U.S.C. 154(b) by 69 days.

(21) Appl. No.: 11/047,219

(22) Filed: Jan. 31, 2005

(65) Prior Publication Data

US 2006/0169192 A1 Aug. 3, 2006

(51) Int. Cl.
*B60R 9/00* (2006.01)
*B63B 17/00* (2006.01)

(52) U.S. Cl. ..... 224/441; 114/343; 224/400; 224/401; 224/406; 224/420; 248/205.1; 248/214; 248/316.8

(58) Field of Classification Search ..... 114/343; 224/406, 420, 441, 400, 401; 248/200, 205.1, 248/207, 214, 309.1, 316.8, 346.01, 346.03
See application file for complete search history.

(56) References Cited

U.S. PATENT DOCUMENTS 4,607,772 A * 8/1986 Hancock ..... 224/442
4,666,110 A * 5/1987 Prouty ..... 248/122.1
6,484,913 B1 * 11/2002 Hancock et al. ..... 224/401
6,588,637 B2 * 7/2003 Gates et al. ..... 224/546
6,945,441 B2 * 9/2005 Gates et al. ..... 224/401
2004/0108348 A1 * 6/2004 Barnes ..... 224/413

* cited by examiner

*Primary Examiner*—Sherman Basinger
(74) *Attorney, Agent, or Firm*—Parr Waddoupr Brown Geal Loveless

(57) ABSTRACT

A mounting bracket for securing one or a pair of article holders to a land or sea craft to facilitate the carrying of articles on the craft; the mounting bracket comprising a non-circular body with opposing flat surfaces and threaded holes extending centrally through the body; a V-notch at one end of the body extending into one flat face and holes through the body at opposite sides of the V-notch and a threaded bore in the end of the body remote from the V-notch; the threaded bores being adapted to reserve a shank of an article holder; and a channel member to fit co-operably over the non-circular body and to hold a pair of spaced apart article holders, while being secured to the body member by a bolt threaded into the body member.

5 Claims, 5 Drawing Sheets

MOUNTING BRACKET

BACKGROUND OF THE INVENTION

1. Field of Invention

Figure 1:
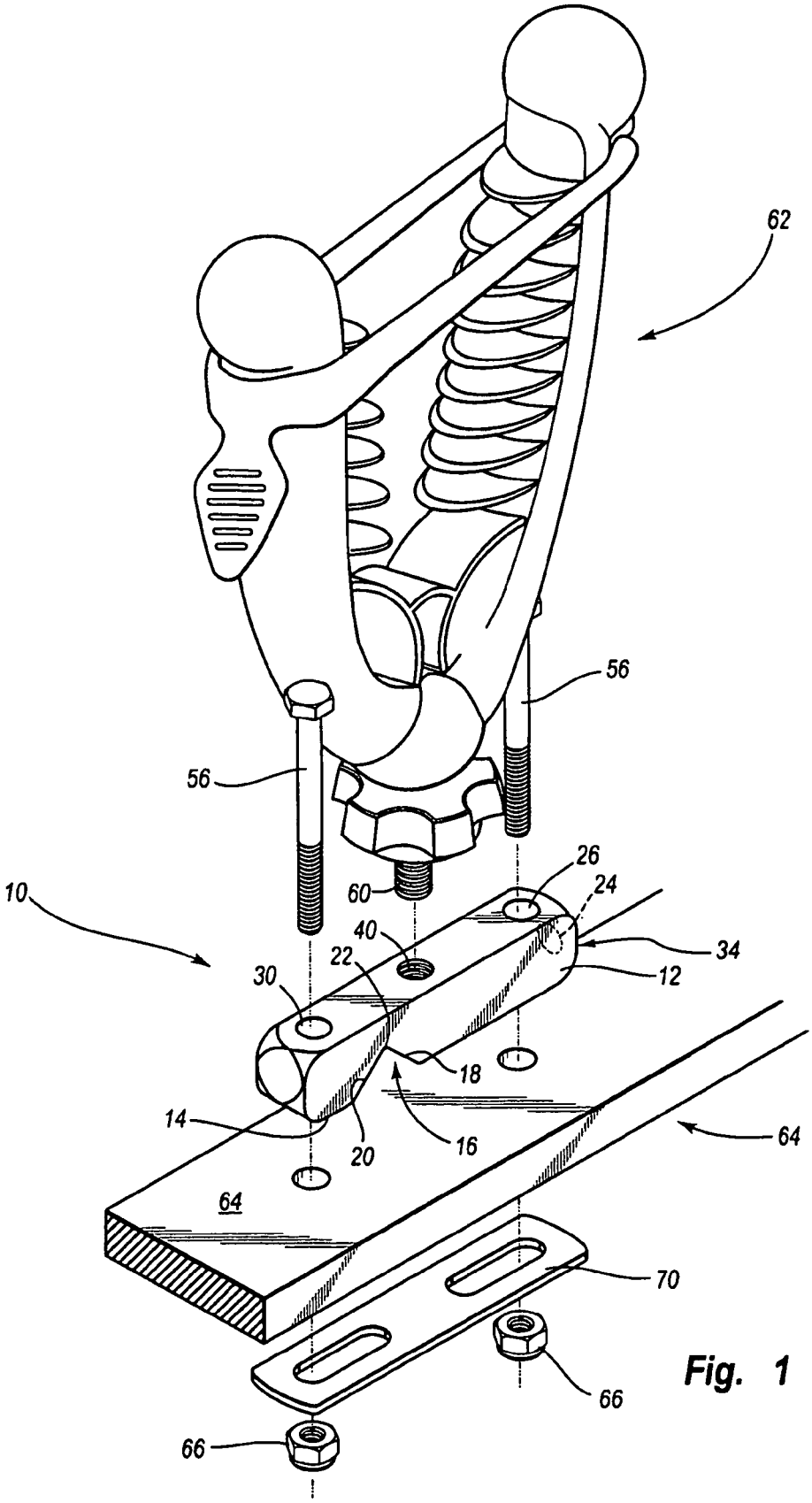

This invention relates to mounting brackets used to secure objects to the handlebars and racks of all terrain vehicles, motorcycles, snowmobiles, personal watercraft and the like.

2. Prior Art

Present day all terrain vehicles, motorcycles, snowmobiles and personal watercraft all have many operating controls and operator assistance items mounted on the handlebars thereof. Thus, brake fluid reservoirs and brake operating levers may be mounted on the handlebars. Even craft such as personal watercraft that do not have brake fluid reservoirs and brake levers mounted thereon have throttle levers and are often equipped with clutch controls, shift levers, rear view mirrors and other control and operating structures as may be considered necessary. Various types of clamps have been provided in the past to facilitate mounting of article holders on ground and watercraft. Nevertheless, there has remained a need for a mounting bracket suitable for use on tubular surfaces, as well as flat surfaces.

It has also been recognized that it is often desirable to carry articles on the handlebars and/or front or rear decks of the identified craft. Thus a mounting bracket must be usable for attachment to round tubing, such as is commonly used for handlebars and for attachment to flat bars commonly used to form front or rear decks.

OBJECTS OF THE INVENTION

Consequently, principal objects of the invention are to provide a mounting bracket that is economically produced, easily used, and useful with a wide variety of land and watercrafts to support and secure a large number of articles to the craft.

Another object is to provide a mounting bracket that can be used individually to secure items, such as rear view mirrors, antennas, flags, etc. in place.

Still another object is to provide an easily mounted bracket that can be used, in pairs, with article holders to secure articles to a craft. Another object is to provide a bracket that can be attached to a ground traveling or water traveling craft and that will allow diverse mounting of an article holder secured to the bracket. It is also an object to provide a mounting racket that will easily support a pair of spaced apart article holders to better hold articles on a craft.

FEATURES OF THE INVENTION

Principal features of the invention include an elongate body having a threaded bore extending into one end thereof.

A V-notch is formed adjacent to a bottom end of the elongate body. The V-notch is formed in a flat face of the elongate body. A pair of holes are formed centrally of the flat face and each extends through the elongate body, from the face to the back of the body. One of the holes is positioned between the V-notch and an adjacent end of the body. The other hole is an interiorly threaded central hole and is positioned at the opposite side of the V-notch.

Still another hole is positioned adjacent to an opposite end of the body. This hole also extends through the body from the front face to the back and transversely through the threaded bore extending into the end of the body.

The elongate body preferably has a non-circular and preferably square cross-sectional configuration, with each of the front face and the back being flat and each of the sidewalls connecting the front face and back being flat. The corners of the top and bottom ends are preferably beveled to prevent catching of the corners on structures with which the mounting bracket is used. The non-circular configuration allows a channel member to fit over the body member and to be secure against rotation. A bolt may be passed through the channel member into either threaded hole or bore in the body member.

Additional objects and features of the invention will become apparent to persons skilled in the art to which the invention pertains from the following detailed description and claims.

BRIEF DESCRIPTION OF THE FIGURES OF THE INVENTION

In the Drawings

Figure 2:
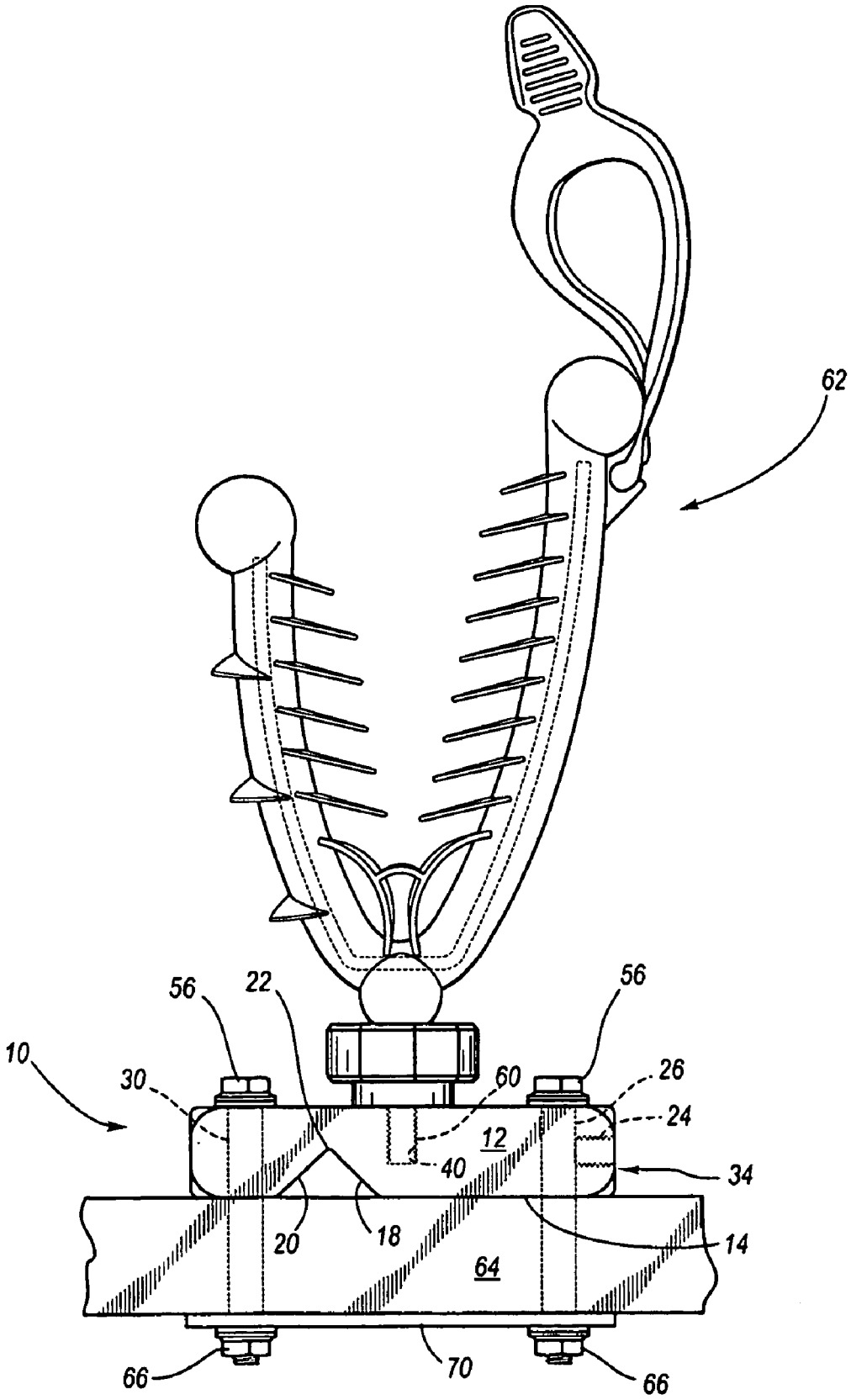
Figure 3:
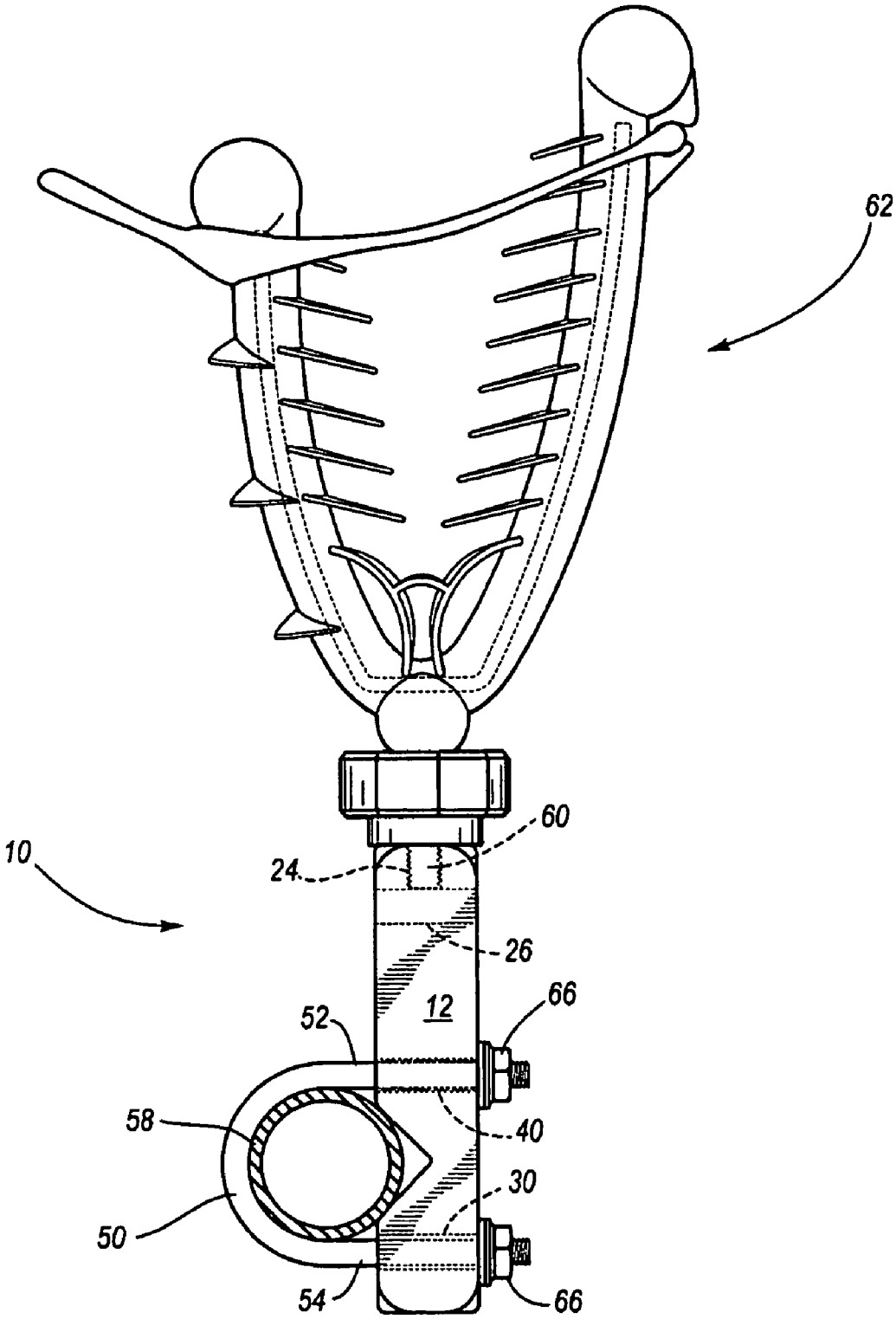
Figures 4, 5:
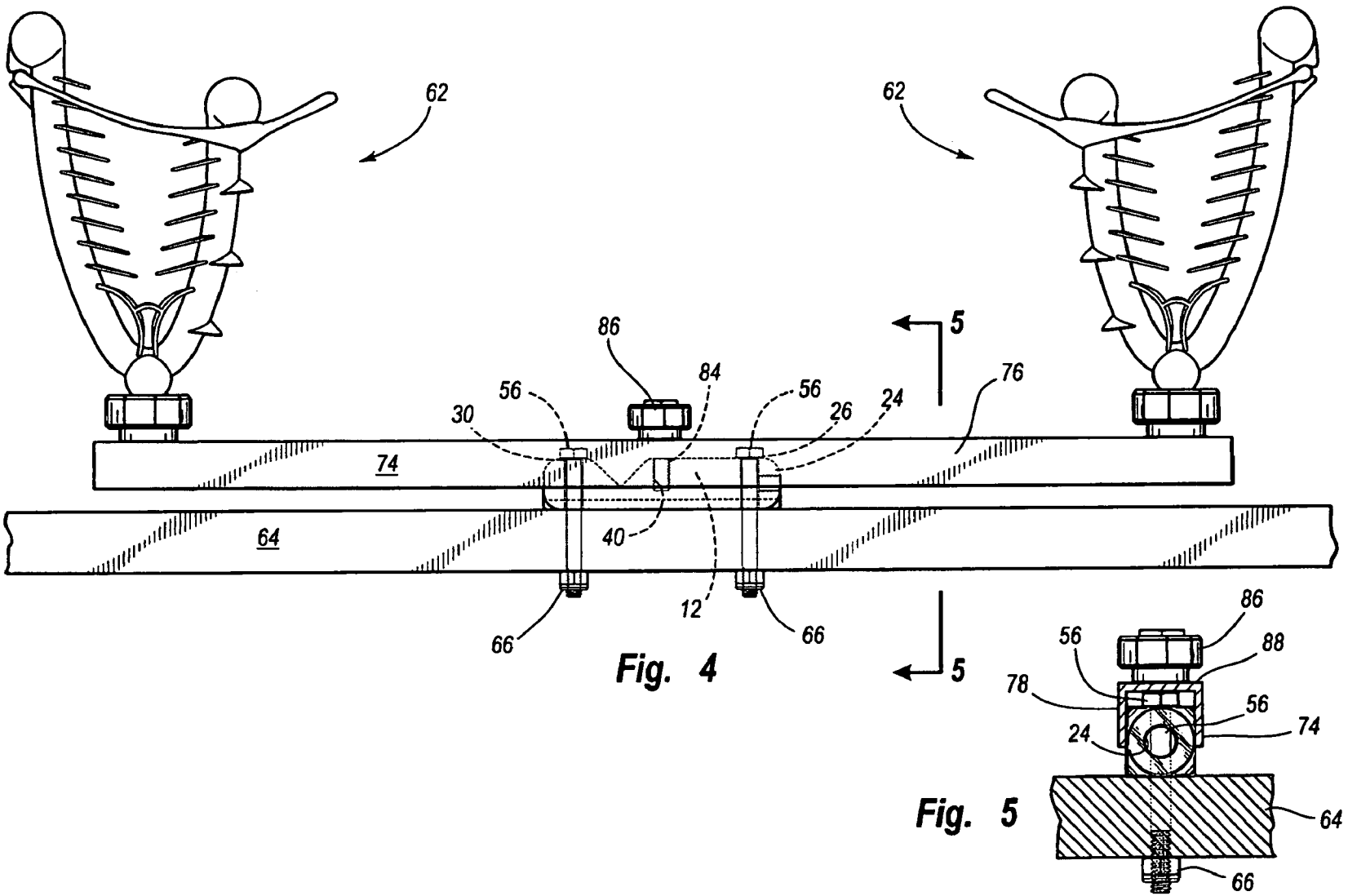

FIG. 1 is an exploded, fragmentary perspective view of the mounting bracket of the invention, and a typical article holder to be mounted thereon;

FIG. 2, a side elevation view of the block of the bracket mounted to a front or rear deck (shown fragmentarily) of an ATV;

FIG. 3, a similar view of the block mounted on a handlebar of an ATV;

FIG. 4, a similar view showing the mounting bracket secured to a front or rear deck of an ATV and with a pair of article holders;

FIG. 5, a vertical section taken on the line 5—5 of FIG. 4; and

Figure 6:
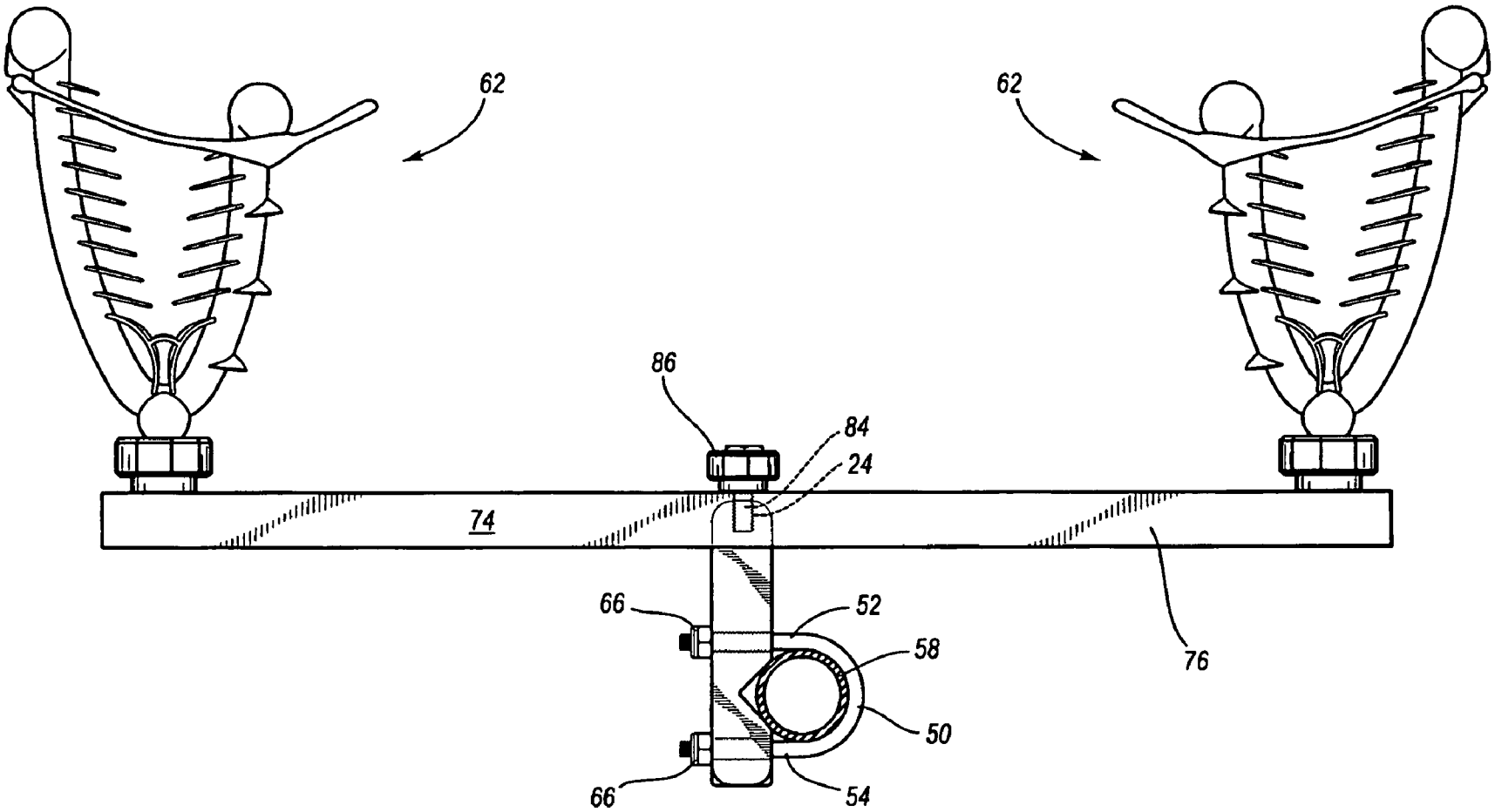

FIG. 6, a similar view showing the block secured to an ATV handlebar and supporting a pair of article holders.

DETAILED DESCRIPTION

Referring now the Drawings

In the illustrated preferred embodiment of the invention, the mounting bracket is shown generally at 10. Mounting bracket 10 includes an elongate body 12 having a square cross-sectional configuration.

Body 12 includes a front flat face 14 having a V-notch 16 formed into the front face 14 and in one end of the body. V-notch 16 includes slanted flat faces 18 and 20 extending from the front face 14 and joining at a juncture 22.

A threaded bore hole 24 extends into the opposite end of body 12 and a hole 26 extends from front face 14 through the body 12 and through the bore hole 24 at the other end of the body 12.

Another hole 30 extends through body 12 from front face 14 to the back 32 and is positioned between V-notch 16 and the other end 34 of body 12.

A center bore 40 is threaded and extends through the body 12 from front face 14 to the back. Bore hole 40 is positioned intermediate the holes 26 and 30.

A U-shaped hasp 50 has spaced apart straight legs 52 and 54 interconnected by a bent central section. The legs 52 and 54 are spaced apart and sized to extend through the holes 26 and 30.

Hasp 50 is sized to straddle a tubular structure, such as a handlebar of an ATV, shown generally at 58.

Threaded holes 24 and 30 are sized to receive a threaded base 60 of an article holder, shown generally at 62.

Holes 30 and 40 are sized to allow full insertion of a leg 52 or 54 of hasp 50.

Holes 26 and 30 are sized to allow bolts 56 to pass through to secure the body 12 and a structure such as a front or rear deck of an ATV, a portion of which is shown at 64, to be secured by nuts 66.

A load distribution plate 70 is provided, if necessary, to secure the body 12 in place to receive an article holder.

A channel member 74 includes a pair of legs 76 and 78 interconnected by a web 88. At least one hole is provided through the web 88 for insertion of a bolt 84 that will thread into hole 40. A knob 86 is preferable provided on bolt 84 to facilitate turning of the bolt.

The mounting bracket 10 of the invention will secure an article holder 62 to a flat surface as shown in FIGS. 1 and 2. For this purpose bolts 56 are inserted through holes 26 and 30 of body 12 and through holes in the flat surface and holes in the plate 70 to be secured by nuts 66.

The threaded shank 60 of article holder 62 is threaded into hole 40 of body 12 and is ready to support articles positioned in the article holder. While a particular article holder 62 is shown, it will be apparent that other suitable article holders could as well be threaded into the hole 40 of body 12.

The mounting bracket 10 may alternatively secure article holder 62 to a tubular member 58 as shown in FIG. 3. In making this attachment, the V-notch 16 is placed to straddle the curve of the tubular member 58. The legs 52 and 54 of hasp 50 straddle the tubular member 59, pass through holes 30 and 40 in the body 12 and are secured by the nuts 66.

The shank 60 of article holder 62 is threaded into hole 24 of body 12. The article holder 62 is then positioned to receive and hold an article positioned therein. As previously noted, an article holder other than the illustrated article holder 62 can be threaded into and secured to the body 12.

The mounting bracket 10 may also include the elongate channel member 74 as a means of mounting a pair of spaced apart article holders 62.

In FIG. 4, a pair of spaced apart article holders 62 are attached to the web 88 of channel member 74. The article holders may be secured to channel member 74 attached with nuts on the shanks 60, or may be otherwise attached.

The body 12 is bolted to a flat surface of member 64 and the channel member 74 is positioned over the body and is secured in place by bolt 84, threaded into hole 40 of the body member 12.

The channel member 74 may also be mounted on the end of body member 12 having hole 24 therein. As shown in FIG. 6, with the body member clamped to a tubular member the channel member 74 will straddle the other end of the body member and bolt 84 can be inserted through the web 80 of the channel member 74 to be threaded into hole 24.

In using the single article holder 62 attached by a mounting bracket 10, a pair of such arrangements are often used to support an article between single article holders.

With a pair of article holders on a mounting bracket, the pair can support an article placed between them. Alternatively, with a pair of mounting brackets, each having a pair of article holders secured thereto, a pair of articles can be carried by positioning each article to extend between one article holder on a mounting bracket and an article holder on the other mounting bracket.

Although a preferred embodiment of my invention has been herein described, it is to be understood that the present disclosure is by way of example and that variations are possible without departing from the subject matter coming within the scope of the following claims, which subject matter I regard as my invention.

I claim:

1. A mounting bracket comprising an elongate body member having a non-circular cross-section and opposed flat faces;

a V-notch formed in one face and adjacent one end of said body member;

a hole at each side of said V-notch and extending through said body member from said one face to an opposing flat face;

the hole at the side of the V-notch remote from the one end being interiorly threaded;

a threaded bore hole in the other end of the elongate body member; and a hole through the body member from the one face to the opposite face and intersecting said threaded bore.

2. A mounting bracket as in claim 1, further comprising a hasp having spaced apart threaded legs connected at one end;

said legs being spaced to fit through the holes formed at opposite sides of the V-notch and to straddle a support structure being straddled by said V-notch; and nuts threaded into said legs of said hasp.

3. A mounting bracket as in claim 1 further comprising bolts inserted through said hole adjacent said one of the body member at the side of the V-notch and the hole extending transverse through the body member from the one face to the opposite face and intersecting said threaded bore hole (to the bore hole through the other end of the body member).

4. A mounting bracket as in claim 1, further comprising an elongate channel member having a pair of apart legs; and said legs each projecting from a web and said legs being spaced to straddle said channel member and having a hole through said web for a bolt inserted through the web and threaded into the threaded bore of said body member.

5. A mounting bracket as in claim 4, wherein the channel member has an article holder fixed to and projecting from each end thereof.

* * * * *